United States Patent [19]

Maier et al.

[11] Patent Number: 4,950,848

[45] Date of Patent: Aug. 21, 1990

[54] ADJUSTABLE CIRCUIT BREAKER WITH DRAW OUT INTERLOCK

[75] Inventors: Alfred E. Maier, Beaver Falls, Pa.; Antonio W. M. Cabral, Ilha Do Governador; Carlos P. S. E. Silva, Rio de Janeiro, both of Brazil

[73] Assignee: Westinghouse Electric Corp., Pittsburgh, Pa.

[21] Appl. No.: 411,130

[22] Filed: Sep. 22, 1989

[51] Int. Cl.[5] ..... H01H 33/42

[52] U.S. Cl. ..... 200/50 AA

[58] Field of Search ..... 200/50 AA, 50 R

[56] References Cited

U.S. PATENT DOCUMENTS 3,772,489 11/1973 Wilson ..... 200/50 AA 4,630,019 12/1986 Maier et al. ..... 337/70

*Primary Examiner*—Robert S. Macon

*Attorney, Agent, or Firm*—M. J. Moran

[57] ABSTRACT

A draw out interlock comprises an elongated interlock member which is coupled to the manual trip mechanism of a circuit breaker. The interlock member is springed bias to an extended position where it projects through the back wall of the circuit, but is retained in a retracted position by the surface against which the circuit breaker is mounted. As the circuit breaker is removed from the mounting surface, the interlock member extends actuating the manual trip mechanism and interrupting current before the circuit breaker becomes disconnected from the protected conductor to prevent arcing at the disconnects.

4 Claims, 5 Drawing Sheets

ADJUSTABLE CIRCUIT BREAKER WITH DRAW OUT INTERLOCK

BACKGROUND OF THE INVENTION

1. Field of the Invention

This invention relates to circuit breakers which have mechanisms for adjusting the current at which the breaker trips and in particular to such circuit breakers which have a mechanism for assuring that the breaker is tripped before it is removed from its mountings.

2. Background Information

Circuit breakers provide a mechanism for opening the circuit through a single or multiphase electrical conductor within a protective enclosure, and typically are provided with means for suppressing the arcs created when large currents are interrupted. Some circuit breakers are provided with quick disconnect type terminals for engaging the electrical conductors in which they are inserted. If the circuit breaker is not tripped before it is disconnected from the conductor it is protecting, large unsuppressed arcs can be generated at the disconnects. This can be dangerous to those removing the breaker and can cause considerable damage to the circuit breaker and conductor terminals.

There is a need, therefore, for a circuit breaker which cannot be disconnected from the conductor it is protecting with the breaker contacts closed.

More specifically, there is a need for a circuit breaker which is automatically tripped as it is disconnected from the electrical conductor in which it is inserted.

There is a further need for such a circuit breaker which is tripped before it becomes disconnected from the electrical conductor.

Most circuit breakers have mechanisms for adjusting the abnormal current conditions under which the breaker trips. These mechanisms can make it more difficult to apply an interlock device for tripping the breaker as it is disconnected from the protected conductor. There is an additional need, therefore, for a circuit breaker with such a trip adjustment mechanism, which is tripped before the terminals become disconnected if an attempt is made to remove the circuit breaker with the circuit breaker contacts closed.

There is particular need for such a circuit breaker which is easily and inexpensively constructed or retrofitted to an existing breaker, yet is reliable.

SUMMARY OF THE INVENTION

These and other needs are satisfied by the invention which is directed to a circuit breaker which includes a manual trip mechanism accessible from outside the circuit breaker housing for tripping the breaker independently of the current in the protected conductor. A draw out interlock mechanism includes an interlock member movable between a retracted and an extended position, biasing means biasing the interlock member to the extended position, and coupling means coupling the interlock member to the manual trip mechanism. The interlock member is coupled to the manual trip mechanism in a manner such that movement of the interlock member to the extended position moves the manual trip mechanism to the actuated position to trip the circuit breaker, yet the manual trip mechanism is free to trip the circuit breaker while the interlock member is in the retracted position.

The interlock member extends through the circuit breaker housing and is retained in the retracted position by engagement with the mounting member on which the circuit breaker is mounted. The interlock member is moved to the extended position by the biasing means as the circuit breaker is withdrawn form the mounting member to trip the circuit breaker through actuation of the manual trip mechanism before releasable terminals on the circuit breaker disengage from the conductor. Thus, interruption of the current in the conductor occurs within the circuit breaker which is provided with arc suppression devices, rather than at the terminals.

BRIEF DESCRIPTION OF THE DRAWINGS

A full understanding of the invention can be gained from the following description of the preferred embodiment when read in conjunction with the accompanying drawings in which.

DESCRIPTION OF PREFERRED EMBODIMENT

Figure 1:
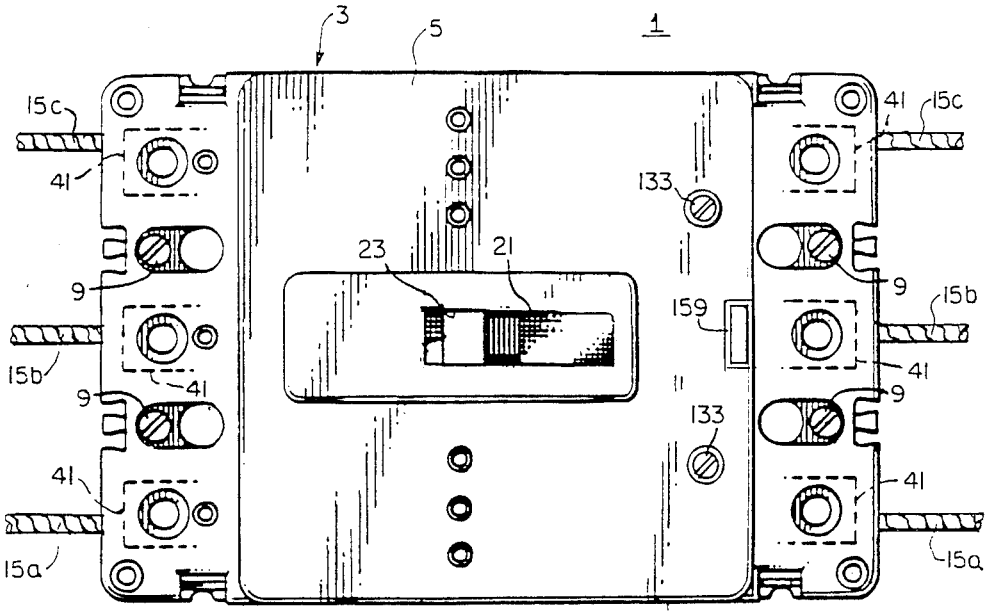
FIG. 1 is plan view of a circuit breaker incorporating the invention.

Referring to the drawings, there is illustrated a molded case circuit breaker 1 incorporating a draw out interlock mechanism in accordance with the teachings of the invention. While the circuit breaker 1 is depicted and described herein as a three-phase, or three-pole circuit breaker, the principles of the invention are equally applicable to single phase or polyphase circuit breakers, and to both ac and dc circuit breakers.

The circuit breaker 1 includes a molded, electrically insulating housing 3 comprising a top cover 5 mechanically secured to a molded, electrically insulating, bottom cover or base 7 by fasteners 9. A set of first spring clip terminals, or line terminals 11 are provided, one for each pole or phase. Similarly, a set of second spring clip terminals, or load terminals 13 are provided at the other end of the circuit breaker base 7. These terminals are used to serially electrically connect circuit breaker 1 into a three-phase electrical circuit including conductors 15*a*, 15*b* and 15*c* through knife terminals 17 and 19, respectively, for protecting a three-phase electrical system.

Figure 2:
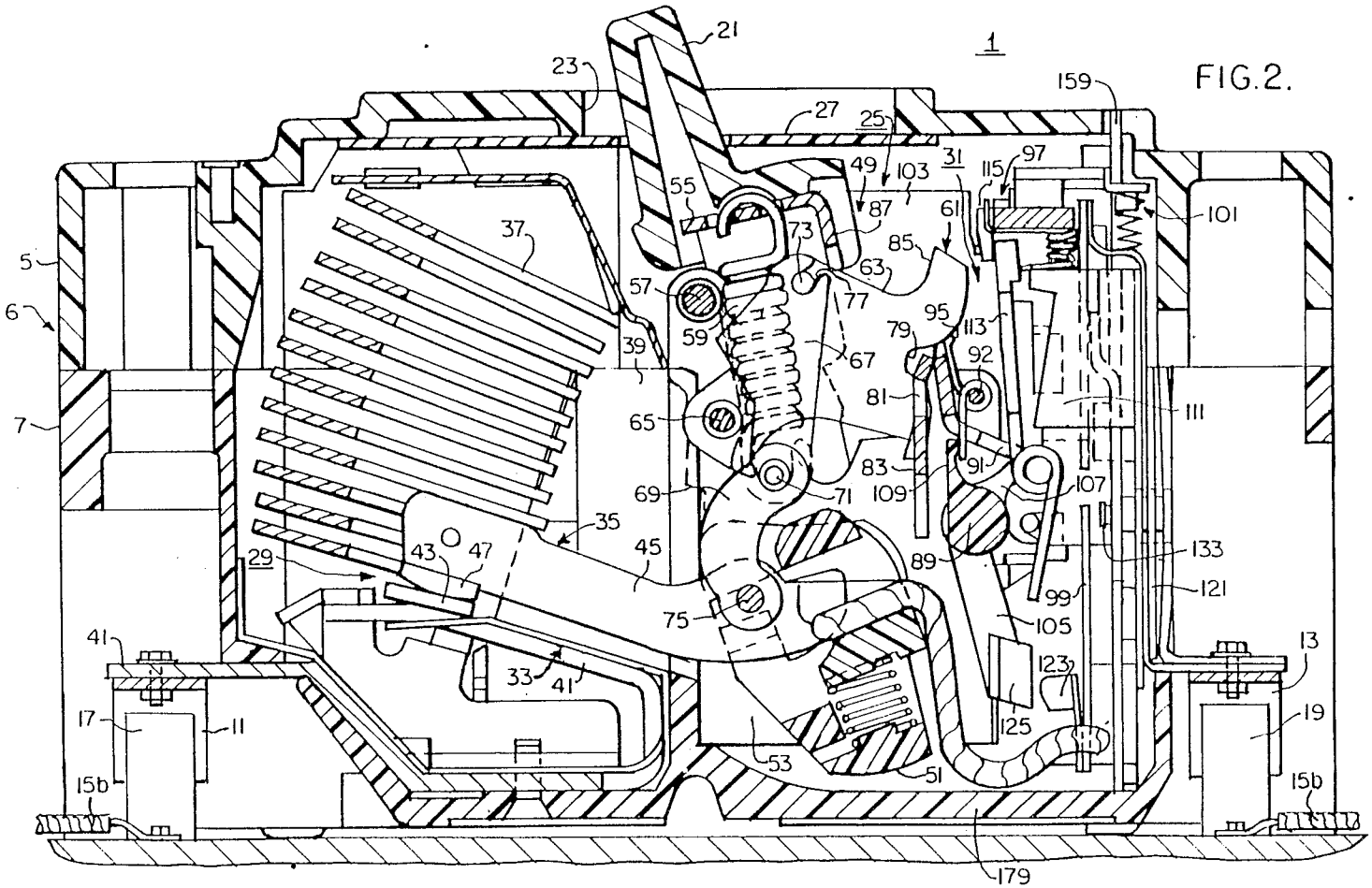
FIG. 2 is a vertical section through the circuit breaker of FIG. 1 showing the circuit breaker in the on position.
Figure 4:
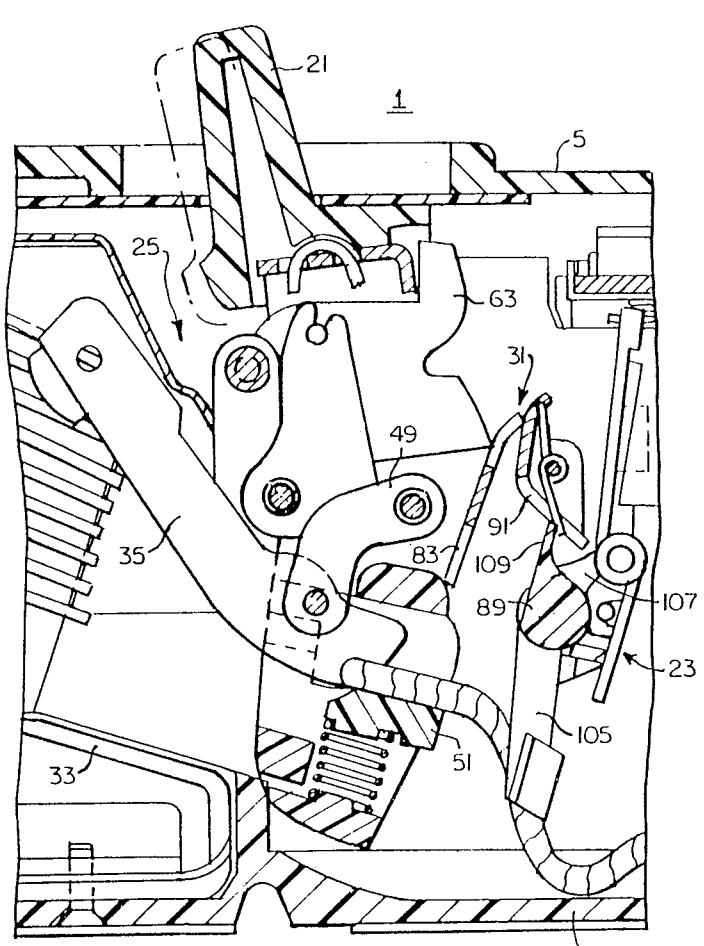
FIG. 4 is a view similar to that in FIG. 3 showing the circuit breaker in the tripped position.
Figure 3:
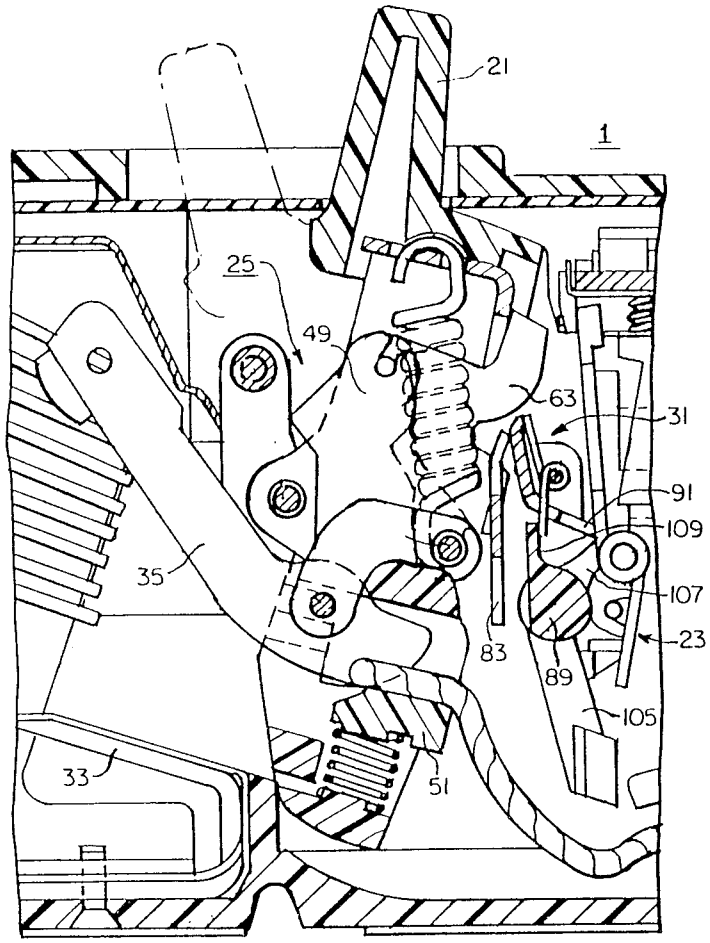
FIG. 3 is a partial vertical section similar to that of FIG. 2 showing the circuit breaker in the open position.

The circuit breaker 1 further includes an electrically insulating, rigid, manually engagable handle 21 extending through an opening 23 in the top cover 5 for setting the circuit breaker 1 to its CLOSED position (FIG. 2) or its OPEN position (FIG. 3). The circuit breaker 1 may also assume a TRIPPED position (FIG. 4). Circuit breaker 1 may be reset from the TRIPPED position to the CLOSED position for further protective operation by moving the handle 21 through the open position (FIG. 3). The handle 21 may be moved either manually or automatically by an operating mechanism 25 to be described in more detail. Preferably, an electrically insulating strip 27, movable with the handle 21, covers the bottom of the opening 23, and serves as an electrical barrier between the interior and the exterior of the circuit breaker 1.

As its major internal components, the circuit breaker 1 includes a set of electrical contacts 29 for each phase, the operating mechanism 25 and a trip mechanism 31. Each set of electrical contacts includes a fixed electrical contact 33 and a movable electrical contact 35. Associated with each set of electrical contacts 29 are an arc chute 37 and a slot motor 39 both of which are conventional. Briefly, the arc chute 37 divides a single electrical arc formed between separating electrical contacts 33 and 35 upon a fault condition into a series of electrical arcs, increasing the total arc voltage and resulting in a limiting of the magnitude of the fault current. The slot motor 39, consisting of either of a series of generally U-shaped steel laminations encased in electrical insulation or of a generally U-shaped electrically insulated, solid steel bar, is disposed about the contacts 33, 35, to concentrate the magnetic field generated upon a high level short circuit or fault current condition thereby greatly increasing the magnetic repulsion forces between the separating electrical contacts 33 and 35 to rapidly accelerate their separation. The rapid separation of the electrical contracts 33 and 35 results in a relatively high arc resistance to limit the magnitude of the fault current. A more detailed description of the arc chute 37 and slot motor 39 can be found in U.S. Pat. No. 3,815,059.

The fixed electrical contact 33 includes a U-shaped stationary member 41 with a contact 43 for physically and electrically contacting the upper electrical contact. The end portion of the member 41 extends exteriorly of the base 7 and serves as a mounting for the spring clip line terminal 11.

The movable electrical contact 35 includes a rotatable contact arm 45 and a contact 47 for physically and electrically contacting the lower electrical contact 33.

The operating mechanism 25 includes an over-center toggle mechanism 49, an integral one-piece molded cross bar 51, a pair a rigid, spaced apart, metal side plates 53, a rigid, pivotable metal handle yoke 55, a rigid stop pin 57, a pair of operating tension springs 59 and a latching mechanism 61.

The over-center toggle mechanism 49 includes a rigid, metal cradle 63 that is rotatable about the longitudinal central axis of a cradle support pin 65 journaled in the side plates 53.

The toggle mechanism 49 further includes a pair of upper toggle links 67, a pair of lower toggle links 69, a toggle spring pin 71 and an upper toggle link follower pin 73. The lower toggle links 69 are secured to either side of the rotatable contact arm 45 of the movable electrical contact 35 by toggle contact pin 75. The ends of the pin 75 are received and retained in the molded cross bar 51. Thus, movement of the movable electrical contact 35, and the corresponding movement of the cross bar 51 are effected by movement of the lower toggle links 69. In this manner, movement of the movable electrical contact 35 by the operating mechanism 25 in the center pole or phase of the circuit breaker 1 simultaneously, through the rigid cross bar 51, causes the same movement in the electrical contacts 35 associated with the other poles or phases of the circuit breaker 1.

The upper toggle links 67 and lower toggle links 69 are pivotally connected by the toggle spring pin 71. The operating tension springs 59 are stretched between the toggle spring pin 71 and the handle yoke 55 such that the springs 59 remain under tension, enabling the operation of the over-center toggle mechanism 49 to be controlled by and be responsive to external movement of the handle 21.

The upper links 67 also include recesses or grooves 77 for receipt and retention of pin 73. Pin 73 passes through the cradle 63 at a location spaced by a predetermined distance from the axis of rotation of the cradle 63. Spring tension from the springs 59 retains the pin 73 in engagement with the upper toggle links 67. Thus, rotational movement of the cradle 63 effects a corresponding movement or displacement of the lower portions of the links 67.

The cradle 63 has a slot or groove 79 defining a flat latch surface which is configured to engage a flat cradle latch surface formed in the upper end of an elongated slot or aperture 81 in a generally flat intermediate latch plate 83. The cradle 63 also includes a generally flat handle yoke contacting surface 85 configured to contact a downwardly depending, elongated surface 87 formed on the upper end of the handle yoke 55. The operating springs 59 move the handle 21 during a trip operation and the surfaces 85 and 87 locate the handle 21 in the TRIPPED position (FIG. 4) intermediate the CLOSED position (FIG. 2) and the OPEN position (FIG. 3) of the handle 21, to indicate that the circuit breaker 1 has tripped. In addition, the engagement of the surfaces 85 and 87 resets the operating mechanism 25 subsequent to a trip operation by moving the cradle 63 in a clockwise direction against the bias of the operating springs 59 from its TRIPPED position (FIG. 4) to to and past its OPEN position (FIG. 3) to enable the relatching of the latching surfaces on groove 79 and in aperture 81.

Further details of the operating mechanism and its associated molded cross bar 49 can be gained from the description of the similar operating mechanism disclosed in U.S. Pat. No. 4,630,019.

The trip mechanism 23 includes the intermediate latch plate 83, a molded one-piece trip bar 89, a cradle latch plate 91, a torsion spring support pin 93, a double acting torsion spring 95, a magnetic trip assembly 97, a thermal trip device 99 in the form of a bimetal, and a manual trip mechanism 101.

Figure 5:
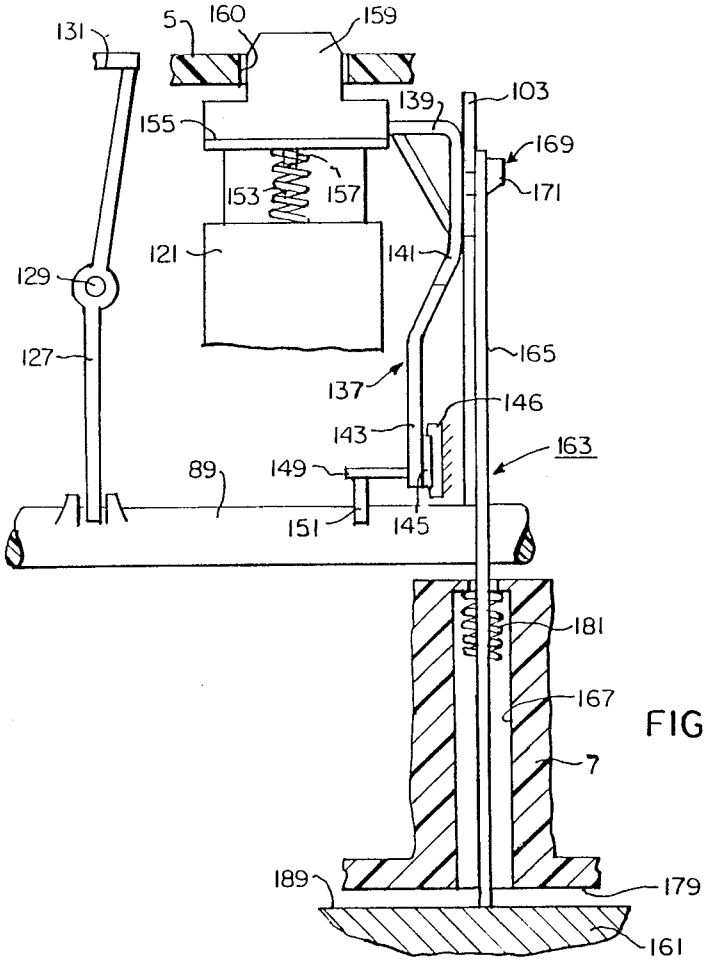
FIG. 5 is a sectional view of selected parts of the circuit breaker of FIG. 1 as viewed from the right in FIG. 2.

The molded one-piece trip bar 89 is journaled in vertical partitions 103 in the base 7 of the molded case circuit breaker 1 which separate the three poles of the circuit breaker. (See FIG. 5.) The trip bar 89 has actuating levers 105 for each pole extending radially downward. (See FIGS. 2, 3, and 4.) A trip lever 107 extending outwardly from the trip bar is engaged by the cradle latch plate 91. Cradle latch plate 91 is mounted for rotation about an axis parallel to the trip bar. One arm of the double acting torsion spring 95 biases the cradle latch plate 91 against the intermediate latch plate 83. The other arm of the torsion spring 95 bears against a vertical projection 109 on the trip bar 89 to bias the trip bar in the counter clockwise direction as viewed in FIG. 2.

With the circuit breaker in the CLOSED position as shown in FIG. 2, the tension springs 59 tend to rotate the cradle 63 in the counter clockwise direction. This is resisted, however, by the cradle latch plate 91 held in place by the trip lever 107 on the trip bar 89 and acting through the intermediate latch plate 83.

The magnetic trip assembly 97 includes a stationary magnetic structure 111, an armature 113, and means 115 for adjusting the magnetic trip.

The armature is pivoted for rotation by a pin 117, a spring 119 biases the armature away from the stationary magnetic structure 111. The adjusting means 115 regulates the current at the which the magnetic trip assembly 97 operates. This adjusting means which is not a part of the present invention is the subject of co-pending, commonly owned U.S. patent application Ser. No. 07/320,647 filed Mar. 8, 1989 entitled "Circuit Breaker with Individual Gap Adjustment at High and Low Settings of Magnetic Trip."

The bi-metal thermal trip device for each phase is electrically connected to the corresponding load terminal 13 through a conductive member 121. The lower end of the bi-metal 99 is provided with a finger 123 which is spaced from a bevelled surface 125 on the lower end of the actuating arm 105 of the trip bar 89. The bevelled surface 125 defines a plane having the left edge in FIG. 2 closer than the right edge. Adjustment of the space inbetween the finger 123 and the surface 125 can be accomplished by two means. A lever arm 127 (see FIG. 5) pivoted by a pin 129 is rotated by a cam device 131 accessible through the top cover 5 to slide the trip bar 89 axially thereby adjusting the spacing between the finger 123 and the bevelled surface 125. Calibration of the bi-metal 99 can be effected at the factory through rotation of a screw 133.

A current bearing conductive path between the lower end of the bi-metal 99 and the movable, electrical contact 35 is achieved by a flexible copper shunt 135 connected by any suitable means, for example by brazing, to the lower end of bi-metal 99 and to the moveable electrical contact 35 within the cross bar 51. In this manner, an electrical path for each phase is provided through the circuit breaker between the terminals 11 and 13 via the fixed electrical contact 33, the moveable electric contact 35, the flexible shunt 135, the bi-metal 99 and the conductive member 121. Since the bi-metal 99 is surrounded by the stationary magnetic structure 111, the current conducted by the bi-metal generates a magnetic field in the stationary magnetic structure which attracts the armature 113.

The manual trip mechanism 101 includes an elongated bracket 137 having an actuating arm 139 extending horizontally from its upper end, and a vertical section 141 with the lower portion 143 offset horizontally. The bracket 137 is mounted for rectilinear vertical movement by guides 145 and 147 which slide in orthogonally oriented vertical grooves 146 and 148, respectively, in the base 7. A trip arm 149 extending laterally from the lower end of the bracket 137 engages an actuating lever 151 on the trip bar 89 to rotate the trip bar and thus trip the circuit breaker with downward movement of the bracket. The bracket 137 is biased upward by a compression spring 153 bearing against a flange 155 extending from the actuating arm 139, and the top of member 121. A boss 157 on the flange 155 retains the spring 153 in place. An insulated button 159 on the actuating arm 139 projects through an opening 160 in the cover 5 where it is accessible for manual tripping of the circuit breaker.

In operation, the circuit breaker 1 is set to the closed position as shown in FIG. 2. A current which exceeds the magnetic trip setting generates a magnetic field in the stationary magnetic structure 111 sufficient to pull the armature 113 toward it in a clockwise direction as viewed in FIG. 2. The lower end of the armature rotates the trip bar 89 in the clockwise direction until the cradle latch plate 91 slides off the trip lever 107. This unlatches the cradle 63 permitting the operating tension springs 59 to rotate the cradle 63 counter-clockwise as viewed in FIG. 2 which causes the toggle mechanism 49 to break over to the position shown in FIG. 4, thereby opening a set of electrical contacts 29. As previously mentioned, this results in rotation of the cross bar 51 which opens the sets of contacts 29 on each of the poles of the circuit breaker 1. In a similar manner, a persistent low level current causes the bimetal 99 to bend bringing the finger 123 into contact with the camming surface 125 of the actuating lever 105 on the trip bar 89, thereby rotating the trip bar 89 and tripping the circuit breaker in the manner discussed above in connection with the magnetic trip.

If it is desired to manually trip the circuit breaker 1, the button 159 is pressed which causes the bracket 137 to move downward against the force of spring 153 to rotate the actuating lever 151 on the trip bar and trip the circuit breaker as previously described.

If the circuit breaker 1 is removed from the structure 161 on which it is mounted with the contacts 29 closed and current flowing through the conductor **15*a*, 15*b* and 15*c*, arcing will occur at the terminals 11 and/or 13. This condition is avoided by the invention which assures that the contacts 29 of the circuit breaker are open when the circuit breaker is disconnected from the conductor 15. This function is formed by the drawout interlock mechanism 163**.

Figure 6:
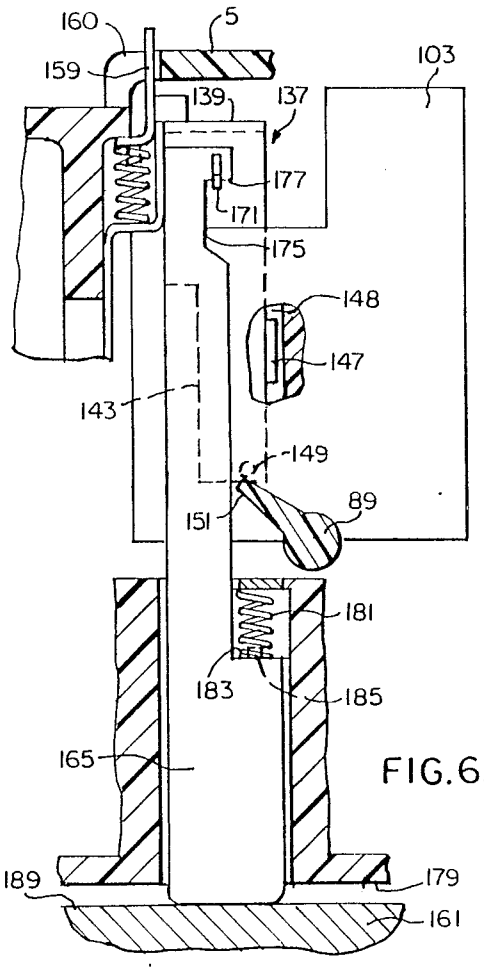
FIG. 6 is an elevation view partially in section of the mechanism shown in FIG. 5 as viewed from the right in FIG. 5.
Figure 8:
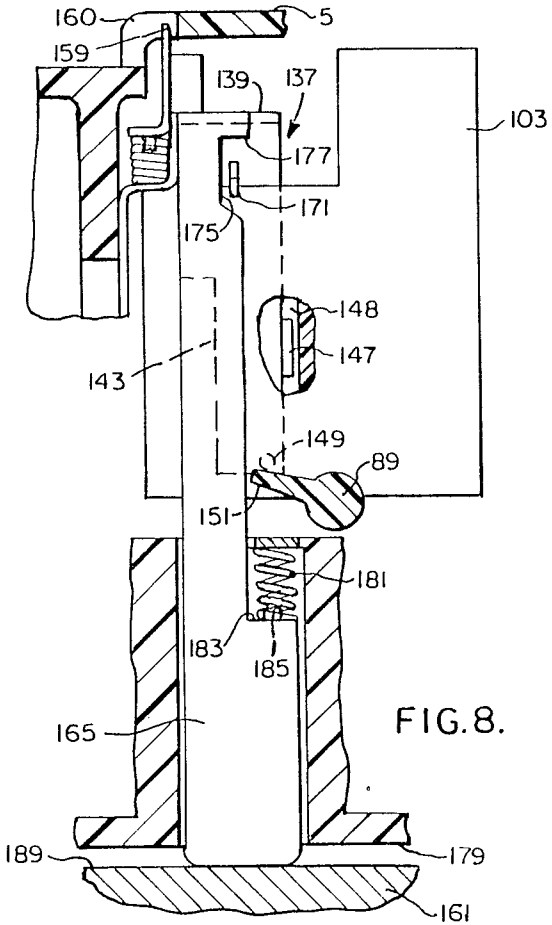
FIG. 8 is a view similar to that of FIG. 6 showing the breaker with the manual trip mechanism actuated while the interlock member remains retracted.
Figure 7:
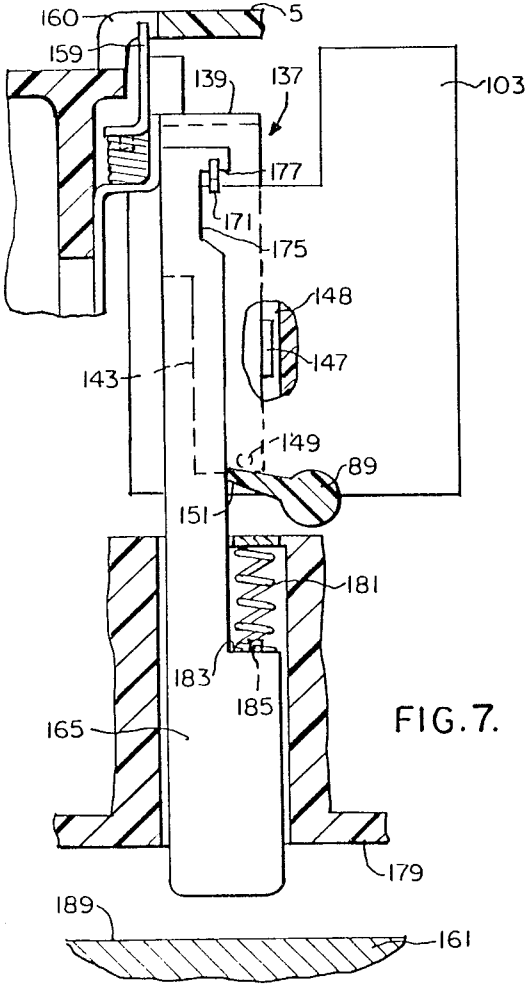
FIG. 7 is a view similar to that of FIG. 6 with the breaker removed from its mounting showing the interlock member in the extended position in which the circuit breaker is tripped.

The drawout interlock mechanism 163 includes an elongated interlock member 165 which is inserted in a slot 167 in the base 7 of the circuit breaker 1. The interlock member is coupled to the manual trip bracket 137 by a coupling 169 which includes a projection 171 extending laterally from the manual trip bracket 137. A notch 175 in the interlock member 165 defines a shoulder 177 which slips over and engages the projection 171. The interlock member 165 is movable between a retracted position shown in FIGS. 5, 6 and 8 in which the lower end of the interlock member 165 is flush with the outer surface of the back wall 179 of the base 7, and an extended position shown in FIG. 7 wherein the interlock member extends substantially beyond the base 7 of the housing. Interlock number 165 is biased to the extended position by a vertical compression spring 181 which bears against a lateral edge 183 on the interlock member 165 and is retained in place by a finger 185 projecting from the ledge 183. The spring 183 also bears against a lateral surface 187 in the slot 167 in the base 7 of the housing. With the circuit breaker in place on the mounting structure 161, the interlock member 165 bears against and is held in the retracted position by the surface 189 of the structure 161 as shown in FIG. 8. The notch 175 in the interlock member 165 is of such a dimension that the manual trip mechanism can be actuated to trip the circuit breaker with the circuit breaker mounted on the mounting structure 161 as shown in FIG. 8. As the circuit breaker 1 is withdrawn from the mounting structure, the spring 181 urges the interlock member toward the extended position shown in FIG. 7. As this occurs, the shoulder 177 on the interlock member 165 engages the projection 171 and pulls the bracket 137 downward with it. This causes the trip arm 149 on the lower end of the bracket 137 to engage the actuating lever 151 and rotate the trip bar to trip the circuit breaker. The dimensions are such that the circuit breaker is tripped before the terminals 11 and 13 disengage from the spring clip terminals 17 and 19 respectively so that current through the conductor 15 is interrupted by the contacts 29 of the circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit breaker releasably mountable on a mounting member in series electrical connection with electrical conductor means to be protected from abnormal currents, said circuits breaker comprising:

electrical contacts operable between a closed position in which a circuit is completed through the conductor means and an open position in which the circuit through the conductor means is interrupted;

a latchable operating mechanism operable to operate said electrical contacts to the open position when unlatched;

a trip bar rotatable from a biased position to a trip position to unlatch said operating mechanism;

an automatic trip assembly responsive to abnormal current flowing through said conductor means to rotate said trip bar to the trip position;

an electrically insulating housing enclosing said electrical contacts, said latchable operating mechanism, said trip bar and said automatic trip assembly;

electrical terminals connected to said electrical contacts within said electrically insulating housing and extending through said housing to releasably engage said electric conductor;

a manual trip mechanism accessible through said electrically insulating housing and movable from outside said housing from an unactuated position to an actuated position to rotate said trip bar to the trip position; and a drawout interlock mechanism including an interlock member movable between a retracted position and an extended position, biasing means biasing said interlock member to the extended position, and coupling means coupling the interlock member to the manual trip mechanism to move said manual trip mechanism to the actuated position with movement of said interlock member from the retracted position to the extended position, but permitting the manual trip mechanism to be moved to the actuated position manually while the interlock member remains in the retracted position, said interlock member being retained in the retracted position by engagement through said housing with said mounting member when said circuit breaker is mounted on said mounting member and said electrical terminals engage said electrical conductor means, and said interlock member being moved to the extended position by the biasing means as said circuit breaker is withdrawn from the mounting member to trip the circuit breaker through actuation of the manual trip mechanism before said electrical terminals disengage from the electrical conductor means.

2. The circuit breaker of claim 1 wherein the interlock member is retracted substantially inside said housing when in the retracted position and extends outside said housing in the extended position, and wherein the mounting member includes a mounting surface which bears against the interlock member to retain the interlock member in the retracted position.

3. The circuit breaker of claim 2 wherein said manual trip mechanism includes a bracket member movable rectilinearly between said actuated and unactuated positions and wherein said coupling means comprises a shoulder defined by one of said bracket member and interlock member and a projection defined by the other member, said projection engaging said shoulder to couple the interlock member to the bracket member to move the bracket member to said actuated position as said interlock member moves from said retracted position to the extended position.

4. The circuit breaker of claim 3 wherein said electrically insulating housing has a front cover through which said manual trip mechanism is accessible and a back wall which abuts said mounting surface when said circuit breaker is mounted on said mounting surface, said rectilinear movement of said bracket member being generally toward and away from said back wall, and said interlock member extending through and generally perpendicular to said back wall.

* * * * *